United States Patent [19]

Andiano et al.

[11] Patent Number: 4,825,567

[45] Date of Patent: May 2, 1989

[54] SAFETY DEVICE INTENDED FOR EQUIPPING A SELF-PROPELLED APPLIANCE HAVING STABILIZERS, ESPECIALLY A PUBLIC WORKS APPLIANCE OF THE SHOVEL-LOADER TYPE

[75] Inventors: Jose Andiano, Lury-sur-Arnon; Germain Houy, Vierzon; Michel Compin, Lury-sur-Arnon, all of France

[73] Assignee: J. I. Case Company, Racine, Wis.

[21] Appl. No.: 171,312

[22] Filed: Mar. 21, 1988

[30] Foreign Application Priority Data

Mar. 31, 1987 [FR] France ..... 87 04501

[51] Int. Cl.[4] ..... E02F 3/76; E02F 9/00

[52] U.S. Cl. ..... 37/117.5; 414/718; 212/189; 74/866; 192/3.58

[58] Field of Search ..... 37/117.5, 103; 74/859, 74/860, 866, 867, 868; 192/3.51, 3.54, 3.57, 3.58; 414/718; 212/189

[56] References Cited

U.S. PATENT DOCUMENTS

| | | | |
|---|---|---|---|
| 3,072,272 | 1/1963 | Howlett | 414/718 |
| 4,049,070 | 9/1977 | Soyland | 37/103 |
| 4,310,975 | 1/1982 | Bibaut | 414/718 |
| 4,400,133 | 8/1983 | Booker | 414/718 |
| 4,474,082 | 10/1984 | Spokas et al. | 74/866 |
| 4,515,520 | 5/1985 | Parquet et al. | 414/718 |
| 4,516,669 | 5/1985 | Bostrom | 192/3.58 |

*Primary Examiner*—Eugene H. Eickholt

[57] ABSTRACT

The invention relates to a safety device for a self-propelled earthmoving appliance having a hydraulic transmission with a reverser and at least one stabilizer which can serve as a support for the said appliance.

According to the invention, the safety device comprises control means connecting the stabilizer control lever functionally to the valve means controlling the position of the reverser, the said control means being passive when the reverser is in the neutral position and active when the reverser is not in the neutral position, in order, in the latter case, to cause a return to the neutral position automatically. Consequently, the raising of the stabilizer or stabilizers can under no circumstances cause a movement of the machine if the control lever of the reverser is not in the neutral position.

The invention is used for equipping appliances of the shovel-loader type having a pair of stabilizers mounted at the rear of the chassis.

12 Claims, 3 Drawing Sheets

SAFETY DEVICE INTENDED FOR EQUIPPING A SELF-PROPELLED APPLIANCE HAVING STABILIZERS, ESPECIALLY A PUBLIC WORKS APPLIANCE OF THE SHOVEL-LOADER TYPE

BACKGROUND OF INVENTION

The present invention relates to the sector of self-propelled handling or public works appliances equipped with at least one stabilizer, for example earthmoving appliances of the shovel-loader type, and more particularly to a safety device intended for equipping such appliances.

There are also certain types of self-propelled excavators on tires, using stabilizing devices (usually a pair at the front and/or at the rear, according to circumstances), to ensure good stabilization of the chassis by bringing the stabilizing devices to bear on the ground.

However, the sector with which the invention is particularly concerned is that of appliances of the shovel-loader type, although this must in no way be considered as a limitation of the subject of the invention.

Such appliances consist, in general terms, of a self-propelled central structure, on which are mounted a front assembly at the front and a hydraulic shovel assembly at the rear: the loader assembly comprising a large-size bucket is used for the loading of materials, whilst the fixed or laterally shiftable shovel assembly comprises a smaller bucket, the orifice of which is generally directed towards the shovel-loader, and is mainly used for digging trenches.

It goes without saying that the term "assembly" used in this description is to be understood in a very broad sense: depending on the particular types of use, there can be, at the front, a fork lift, a sweeper, a bulldozer blade or a snow plough and, at the rear, a pneumatic hammer or concrete-breaker, a rock-cutting tooth, an auger, a grab, a trapezoidal bucket, a ditch-cleaning bucket, a pruner or a tree-dozer.

In fact, with most of the assemblies located at the rear of such appliances, one or more stabilizers, of which the position relative to the ground is controlled by means of an associated lever, may be used.

In practice, at the rear there is a pair of stabilizers which, when brought in contact with the ground, make it possible to ensure the stability of the appliance by lifting the latter slightly in the region of its rear drive wheels. However, the invention is not limited to this common use, but also relates to appliances having four stabilizers with four drive wheels or having a single sliding stabilizer.

The structure of these stabilizers can vary (telescopic structures of the jack type, the rod of which ends in a bearing shoe, or articulated arms which are generally in an axis parallel to the longitudinal direction of the appliance and which likewise end in a bearing shoe). However, the function of these stabilizers remains essentially the same: to ensure the stability of the appliance during work carried out with the rear assembly, in particular a hydraulic shovel.

The rest of the description will mention the "lowering" and "raising" of the stabilizers, and this must be understood in a broad sense embracing the various possible types of structure. Likewise, reference will be made to an "earthmoving appliance" with a pair of stabilizers which are arranged at the rear of the appliance and of which the position relative to the ground is controlled from inside the cab by means of an associated lever: this hypothesis, although being the most common, is nevertheless in no way limiting.

When the driver of a shovel-loader wishes to use the rear assembly, particularly a hydraulic drag shovel, he rotates his seat through 180° to gain access to the various control levers. In particular, the driver actuates the levers controlling the lowering of the stabilizers, until the desired lifting of the wheels is obtained; moreover, he may very probably act on either one of these levers in order to correct the sitting position on a cross slope.

This operation is of course carried out when the appliance is stationary, that is to say the driver has put the lever controlling the reverser of the direction of movement of the gear-change lever into neutral.

It is appropriate to note that transmissions of the hydromechanical type usually possess a movement reverser actuable without disengaging the clutch. Mention will be made, in this case, of a clutch reverser or movement reverser, reference sometimes being made to the term "power shift" used in the agricultural sector; moreover the transmission will often have a front clutch and a rear clutch, with a neutral position of the reverser, and the driver can put the reverser into the neutral position directly by associated valve means which are well known in this sector, means of the electromechanical type actuated directly by the said control lever, or any other equivalent means.

When the driver wishes to move the appliance, he has to raise the stabilizers until the said appliance rests on its wheels once again; he then rotates his chair once more in order to resume the driving position and then acts on the control lever of the reverser to change to forward movement or movement in reverse.

However, it can happen that, when the appliance is still resting on its stabilizers, the driver either inadvertently knocks the control lever of the reverser or has neglected to return the said lever to neutral after a checking operation.

In this case, as soon as the rear wheels of the appliance touch the ground, the machine moves in a way which the driver does not expect. He then has to react quickly to return the control lever to the neutral position, since the movement of the appliance can be a danger to the environment and, above all, to a person who may be knocked over by the machine or wedged between the loading bucket and a natural obstacle.

It can easily be appreciated that several seconds are required for the driver to become aware of this, then act to rotate his seat (which is often locked in the rear working position) and finally reach the control lever of the reverser or one of the safety devices usually provided (foot pedal and/or push-button located at the end of the control lever of the loader assembly), and this risks having consequences which are distressing and even dramatic in some cases.

Consequently, the manufacturers are now studying safety devices intended for equipping these appliances in order to eliminate the abovementioned risk.

One solution could involve purely and simply blocking the action of the control levers of the stabilizers when the reverser lever is not in the neutral position.

Such a device would have the advantage of simplicity, but in practice there would be disadvantages: in fact, the driver must first be aware that the lever or levers on which he acts have no effect on the stabilizers, he must then rotate his chair to reach the control lever of the reverser and finally he must return to the rear working position once again, in order to act on the control levers of the stabilizers. These operations are complicated for the driver and make him waste what may be valuable time.

The object of the invention is to provide a safety device capable of "cutting off" the transmission of the appliance automatically during the control of the raising of the stabilizers, when the control lever of the reverser or the equivalent control means used is not in neutral.

Another object of the invention is to provide a safety device making it possible to alert the driver when the transmission reverser has been returned to the neutral position without his knowledge, so that he can put the appliance back into operation under normal conditions.

Another object of the invention is to provide a safety device of a simple design which requires inexpensive actuating means and which is easy to install on an appliance on which the manufacturer had not provided anything for this purpose, at the same time even profiting from existing mechanical and/or electrical equipment.

SUMMARY OF INVENTION

According to the invention, in a safety device intended for equipping a self-propelled appliance, especially a public works appliance of the shovel-loader type, the said appliance possessing, in a way known per se, a transmission with a clutch reverser, the position of which is controlled by associated valve means, and at least one stabilizer, of which the position relative to the ground is controlled by an associated member, the said device has control means connecting the control member of the stabilizer functionally to the valve means controlling the position of the clutch reverser of the transmission, the said control means being passive when action is taken on the said member and the reverser is in the neutral position and being active when action is taken on the said member and the reverser is not in the neutral position, in order, in the latter case, to put the said reverser into the neutral position automatically.

It is possible to make do with a simple version, in which the control means are active only when action is taken on the control member of the stabilizer for the purpose of raising or folding up said stabilizer.

Where an appliance possessing at least two stabilizers is concerned, the position of each of the stabilizers relative to the ground being controlled by an associated member, it is advantageous if the control means are active when action is taken on any one of the stabilizer control members and when the reverser is not in the neutral position.

As regards an appliance possessing a clutch-reverser control member acting directly on the associated valve means, it is particularly expedient if the control means remain active when action is taken on the stabilizer control member or any one of the stabilizer control members, as long as the control member of the reverser has not been returned to neutral.

Advantageously, the control means connecting the stabilizer control member or members functionally to the valve means controlling the position of the reverser comprise:

- a contactor associated with the or each stabilizer control member, the said contactor being fed continuously when the appliance is in operation;
- a first switching member of the type comprising a relay with a moveable contactor actuated by a trigger coil, the said coil being fed when the contactor or one of the contactors is actuated;
- a second switching member likewise of the type comprising a relay with a moveable contactor actuated by a trigger coil, the said coil being fed when the contactor or one of the contactors is actuated, the input of the second switching member being connected to the output of the first switching member, whilst the output of the said second switching member is connected to the valve means; and
- rectifier means, such as a diode, disposed in an electrical connection between the output of the second switching member and the contactor or contactors, to prevent the, or one of the, stabilizer control members from exerting action on the said control means when the reverser is already in the neutral position.

In particular, the device according to the invention also has alarm means connected to the output of the second switching member, in such a way that the said alarm means is reactivated only when the neutral position is assumed as a result of the control means; preferably, therefore, the alarm means consist essentially of the warning indicator of the appliance, second rectifier means, such as a diode, being provided to prevent normal use of the warning indicator from causing the control means to be actuated and the reverser to be put into the neutral position automatically.

Moreover, as regards an appliance possessing a safety member mounted on the manual control member of an assembly and/or a foot-actuable safety member connected directly to the valve means controlling the position of the reverser for putting the reverser into the neutral position rapidly, it is advantageous if the device according to the invention also has third rectifier means, such as a diode, to prevent normal use of the safety member from causing actuation of the alarm means, especially of the warning indicator of the appliance.

In addition, where an appliance possessing a relay associated with the starter and a safety contactor associated with the circuit of the trigger coil of the said relay is concerned, the said safety contactor being opened automatically when the control member of the reverser is not in neutral, it is expedient if the circuit of the trigger coil of the first switching member is connected to the circuit associated with the said starter relay for the purpose of automatically exciting the said coil controlled by the said safety contactor when the control member of the reverser is in neutral.

In particular, where an appliance possessing a general key-contact member is concerned, it is advantageous if the contactor or contactors associated with a stabilizer control member are fed directly from a terminal of the general key-contact member; in particular, the contactor or contactors are microswitches.

BRIEF DESCRIPTION OF DRAWINGS

Other characteristics and advantages of the invention will emerge more clearly from the following description and the accompanying drawings relating to the particular embodiment, with reference to the figures of which.

DESCRIPTION OF PREFERRED EMBODIMENT

Figure 1:
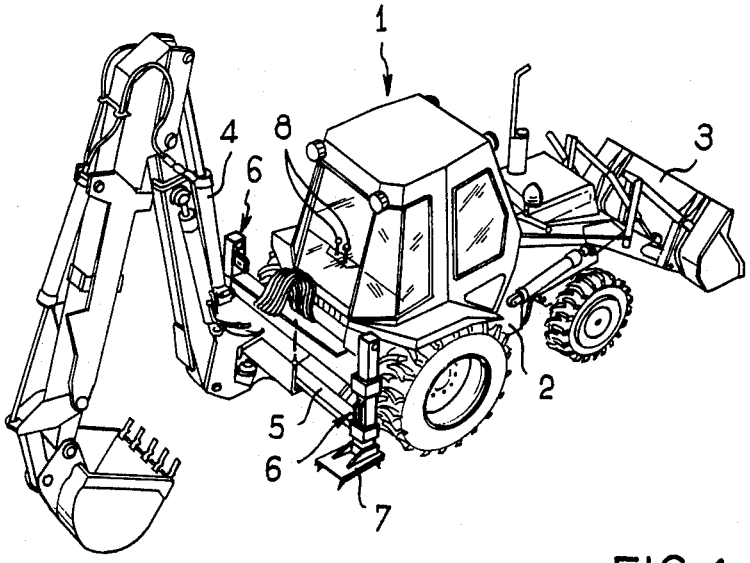
FIGS. 1 and 2 illustrate two types of earthmoving appliances respectively using stabilizers of the telescopic type and of the type with an articulated lateral arm.

FIG. 1 illustrates an earthmoving appliance 1 of the shovel-loader type, the central structure 2 of which supports a front working assembly 3 of the loader-bucket type and a rear working assembly 4 of the hydraulic-shovel type. In the driving position, the driver can observe the front assembly directly, whereas he must rotate his seat through 180° to work with the rear assembly. The rear assembly, here of the shiftable type because of its sliding mounting on a frame 5, can be controlled from the cab of the appliance by means of levers especially provided for this purpose. However, before the rear assembly is used, the driver first takes the trouble to stabilizer the appliance: for this purpose, the earthmoving appliance has a pair of stabilizers 6 which are of the telescopic type here and the lower end of which carries a bearing shoe 7; a lever 8 is provided for controlling the lowering or raising of each stabilizer. Thus, the driver, by lowering these stabilizers, can lift the appliance slightly and have greater stability (it is appropriate to note that, with this type of earthmoving appliance, in practice the loader bucket is used as a front stabilization means, the said bucket simply being allowed to rest on the ground).

As will be understood better from the following description, the safety device according to the invention makes it possible to "cut off" the transmission of the appliance automatically during the raising of the stabilizers 6, if the control lever of the reverser or the equivalent control means used is not in neutral; in this case, if the driver actuates at least one of the levers 8 in order to bring the appliance back onto its wheels, the rear wheels will still be stopped at the time when they make contact with the ground, so that it is quite certain that the machine can under no circumstances move during the raising of the stabilizers, even if the transmission reverser is not in the neutral position.

Figure 2:
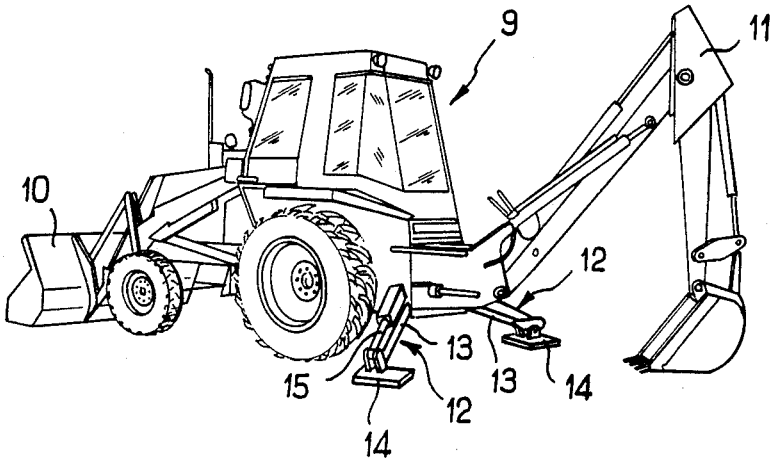

FIG. 2 illustrates an appliance 9 of the same type as the preceding appliance, with a loader bucket 10 at the front and a hydraulic drag shovel 11 at the rear, but using stabilizers of a different structure. In fact, it will be seen that there is a pair of stabilizers 12 which, here, are in the form of an articulated arm 13, of which the end furthest away from the appliance terminates in a bearing shoe 14, these stabilizers being lowered or raised by means of hydraulic jacks 15 controlled from inside the cab of the appliance.

As before, this earthmoving appliance can be equipped with a safety device according to the present invention, making it possible to "cut off" the transmission of the appliance automatically during the raising of the stabilizers 12, if the control lever of the reverser or the equivalent control means used is not in neutral.

It will be appreciated that the safety device can be used for self-propelled appliances of very different types employing at least one stabilizer, the structure of which can likewise vary according to the particular appliance or the particular use.

Figure 3:
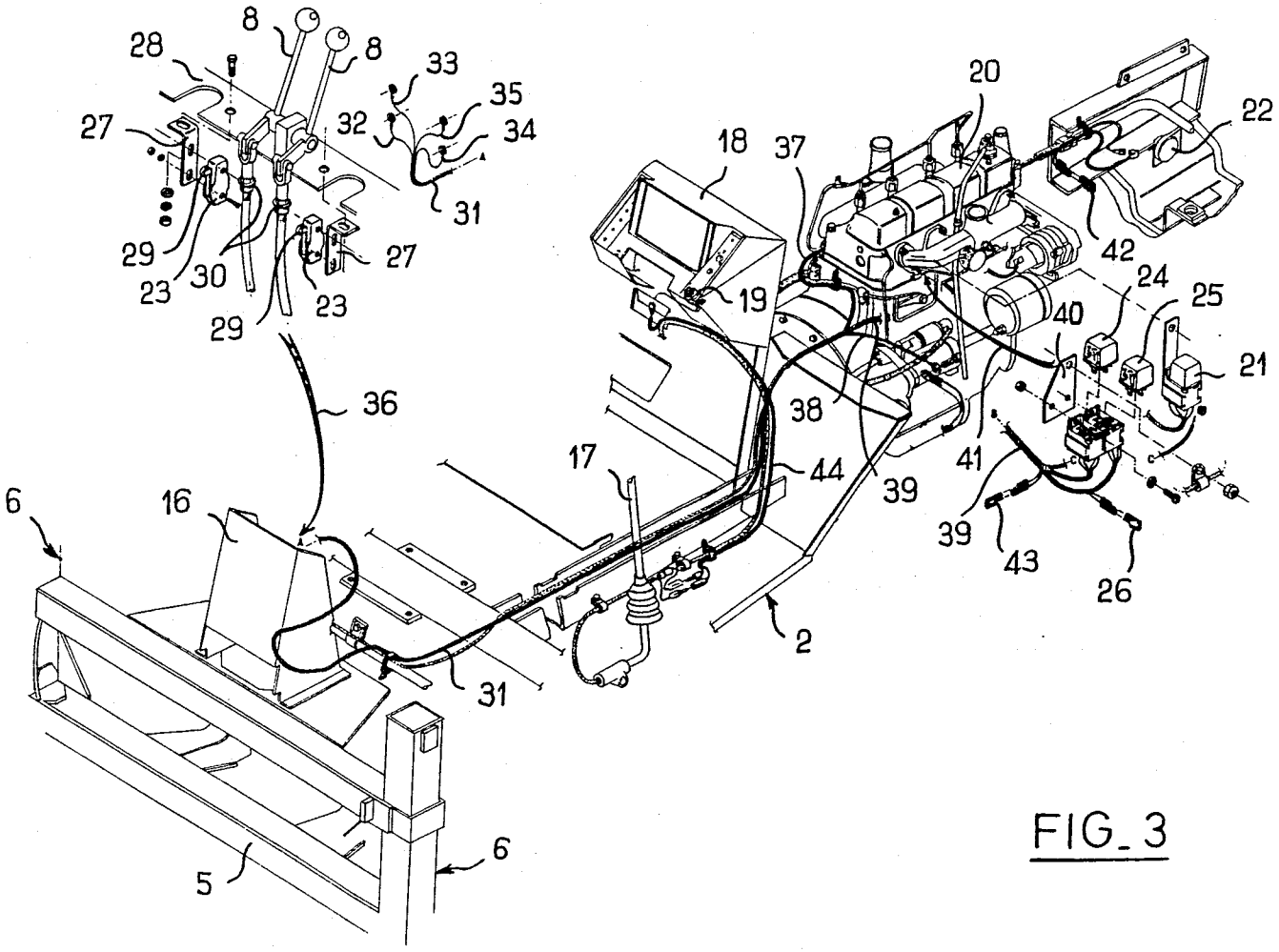
FIG. 3 is an exploded perspective view, in which the partial existing structure of an appliance similar to that illustrated in FIG. 1 (the existing structure is represented, here, by light solid lines) is equipped with a safety device according to the invention.

The exploded perspective view of FIG. 3 gives an illustration of an embodiment of the safety device according to the invention which can be installed on an appliance of conventional design of the shovel-loader type illustrated in FIG. 1.

Figure 4:
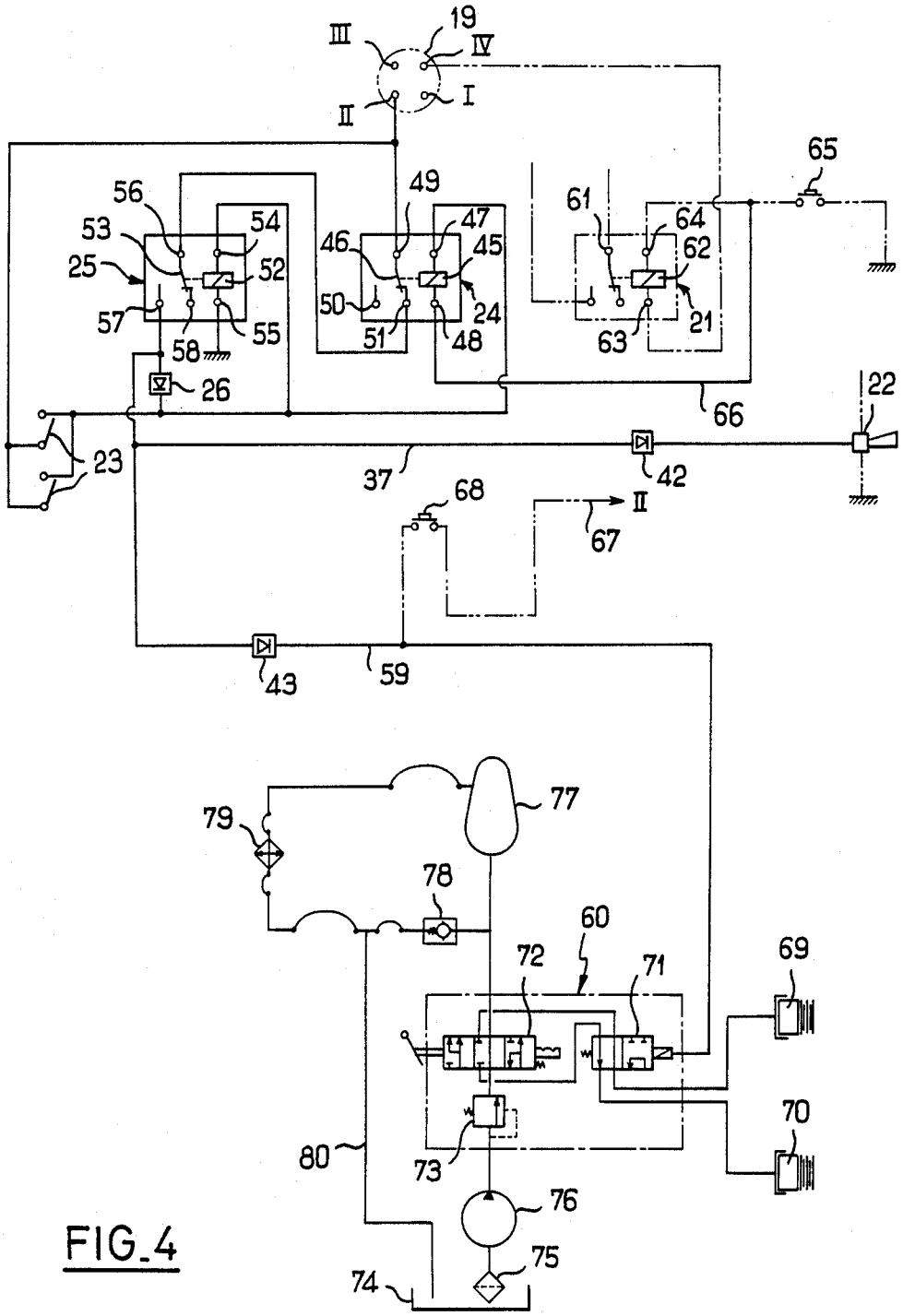
FIG. 4 illustrates in more detail the general structure of the safety device of FIG. 3 and its connection to typical control members provided on a self-propelled earthmoving appliance, the transmission of which incorporates a reverser.

The structure and arrangement of the various functional members of which this safety device is composed will be described in more detail with reference to FIG. 4, but FIG. 3 already makes it possible to understand the general organisation of the device according to the invention and its incorporation in an appliance of conventional design.

To reveal more clearly the structural elements of the safety device according to the invention, the existing structure of the appliance has simply been sketched in light solid lines, the structural elements of the safety device being emphasized in relatively bold lines.

It is thus possible to see, from the rear forwards, the frame 5 supporting the rear assembly of the shiftable type and a pair of stabilizers 6 of the telescopic type, and a control panel 16 for operating the rear assembly and the stabilizers 6: for the latter, the pair of associated levers 8 is used, these being shown offset for the sake of clarity in the drawing. The lower end of the lever 17 will then be seen, this making it possible to control the clutch reversal of the transmission directly from the cab: the lever 17 will be designated hereinafter as a reverser lever, on the understanding that this lever acts on valve means which will be described later and which directly control the actual reverser forming part of the transmission of the appliance. There will then be seen a front instrument panel 18, in particular a general key-contact member 19. At the front, there is the drive unit 20 with a hydro-kinetic torque converter, which is usually coupled to a movement reverser ensuring flexible and instantaneous reversals of the direction of movement, even at full speed. A relay 21 mounted on the engine block and associated with the starter of the latter in an entirely conventional way can also be seen. Finally, at the front of the appliance, there is a warning indicator 22 which can advantageously be used as an alarm means within the scope of the present invention, as will be described later.

There is no need to describe the various connections of the abovementioned members in more detail, these connections being indicated by thin lines since they are of an entirely conventional type.

According to the present invention, there is a safety device comprising control means connecting the control levers 8 of the stabilizers 6 functionally to the valve means controlling the position of the clutch reverser of the transmission: according to an essential aspect of the present invention, these control means are passive when action is taken on at least one of the control levers 8 and the reverser is in the neutral position, and are active when action is taken on at least one of these levers and the reverser is not in the neutral position, in order, in the latter case, to put the said reverser into the neutral position automatically.

According to an especially simple embodiment illustrated here, these control means comprise a contactor 23 associated with each stabilizer control lever 8, first and second switching members 24, 25 of the type comprising a relay with a movable contactor actuated by a trigger coil, and a rectifier means 26, such as a diode, provided at the output of the second switching member 25.

Here, the contactors 23 are in the form of micro-switches and are fastened by means of plates 27 to the board 28 of the rear control panel 16. The contactors 23 comprise a contact roller 29 which can interact with a projecting ring 30 mounted on the linkage of each of the stabilizer control levers 8. It is appropriate to note that this type of microswitch is of the single-contact kind here, that is to say the safety device described has control means taking effect only when action is taken on at least one of the levers 8 for the purpose of raising the associated stabilizer or stabilizers; it goes without saying that such contactors could be replaced by equivalent means activating the control means both to lower and to raise the stabilizer or stabilizers.

From the contactors 23 onwards, there is a wiring harness 31 gathering together the connections 32, 33 to the "on" and "off" terminals of the right-hand micro-switch and 34, 35 to the equivalent terminals of the left-hand micro-switch; the rest of the harness continues along A—A, as indicated by the arrow 36. At the other end, there is a connecting branch 37 to the warning indicator 22, a connecting branch 38 connected to earth, and a main branch 39 extending along B—B for connecting the control means 24, 25, 26 of the safety device according to the invention and the relay 21 associated with the starter, as indicated by the connection C—C. The control means are mounted on a plate 40 itself fastened to the engine block, as indicated by the arrow 41. It will also be seen that there are two other rectifier means of the diode type which are likewise advantageously provided: thus, there is a diode 42 associated with the connection 37 to the warning indicator 22 (to prevent a normal use of the warning indicator from causing the control means to be actuated and the reverser to be put into the neutral position automatically) and a diode 43 associated with the main harness (to avoid causing the acoustic warning indicator 22 to function when the operator uses a safety member making it possible to cut off the reverser and taking the form of a pushbutton located at the end of the reversar lever 17 and/or a simple contactor actuated by a pedal provided especially for this purpose).

The connecting branch 44 illustrates how power is supplied to the contactors 23 and the various switching members of the relay type by a direct tap from a terminal of the general key-contact member 19: this is preferable to a current tap from the battery of the appliance, the result of which would be continuous excitation of the switching members. The other end of the connecting branch 44 is connected to the reverser harness going towards the valve means controlling the position of the said reverser.

The operation of the safety device according to the invention will be described in detail with reference to FIG. 4, but it is useful to describe briefly the various modes of operation with reference to the members shown in FIG. 3.

Thus, if the control lever of the reverser 17 is in neutral, action on one and/or the other of the levers 8 can control the raising of the associated stabilizer or stabilizers 6, according to conventional designs: the control members are such that the current coming from the contactors 23 cannot flow either towards the acoustic warning indicator 22 or towards the valve means controlling the position of the reverser.

In contrast, if the control lever of the reverser 17 is not in neutral (in the front or rear position), any action on any one of the stabilizer control levers 8 will put the reverser into the neutral position automatically as a result of direct action on the valve means controlling the position of the said reverser: thus, when the raising of the stabilizers is such that the appliance once again rests on its rear wheels, the effect of the automatic cut-off of the transmission is to prevent the machine from moving. The driver, who faces the rear and therefore does not necessarily see the position of the control lever of the reverser, is warned of this situation by the actuation of an alarm device, in particular the warning indicator of the appliance. He then has to reactivate the system, and the control means of the device according to the invention are such that this reactivation is carried out simply by returning the control lever of the reverser 17 to neutral, which moreover automatically stops the noise of the acoustic warning indicator. The driver is then once again faced with a normal situation allowing the machine to move.

The general structure of the safety device according to the invention and its connection to the control members conventionally provided on the appliance will now be described in detail with reference to FIG. 4.

The first switching member 24, which will be referred to below simply as a relay 24, has a trigger coil 45 which is capable of actuating a moveable contact member 46 and with which is associated a feed circuit connected to the input and output terminals 47 and 48; the moveable contact member 46 can thus make contact between the input terminal 49 of the relay and one of the output terminals 50, 51. Likewise, the second switching member 25, referred to below simply as a relay 25, has a trigger coil 52 which is capable of actuating a moveable contact member 53 and with which is associated a feed circuit connected to the input and output terminals 54, 55; the moveable contact member 53 can thus make contact between the input terminal 56 of the relay and one of the output terminals 57, 58 of the said relay.

The current tap takes place, here, at the general key-contact member 19 via the terminal 11, to which the input terminal 49 of the relay 24 is connected. It is appropriate to note that the input terminal 56 of the relay 25 is connected to one of the outputs 51 of the relay 24. Moreover, the feed input 47, 54 of each trigger coil is connected directly to the contactors 23 (represented diagrammatically here in the form of breaker switches). Also here again is the diode 26 which is located at the output of the second relay 25 and between 25 and 26 are, on the one hand, the connecting branch 37 leading to the acoustic warning indicator 22 via a diode 42 and, on the other hand, a branch 59 leading via a diode 43 to valve means 60 controlling the transmission reverser.

It will also be seen that there is (represented by light solid lines) the starter relay 21, of which the input terminal 61 is connected to the starter (not shown) and of which the trigger coil 62 has a feed circuit with an input 63 connected to the terminal IV of the general key-contact member 19 and an output 64 connected to earth via a safety contactor 65, the said contactor being opened automatically when the control lever of the reverser 17 is not in neutral. The relay 21 and the safety contactor 65 are conventionally provided on existing appliances, thus making it possible to appreciate the ease with which the safety device according to the invention can be connected to an existing system, in particular here by means of a branch 66 of the earth circuit of the trigger coil of the relay 24, the connection being upstream of the safety contactor 65. FIG. 4 also shows a connecting branch 67 connecting the terminal II of the general key-contact member 19 to the valve means 60 controlling the reverser by way of a safety member 68. Such a circuit is conventionally provided on existing appliances, the safety member 68 moreover often being duplicated: on the one hand, a pushbutton arranged at the end of a manual control lever of the loader assembly and, on the other hand, a foot-actuable member provided under the driver's chair (these safety members are of conventional design and therefore have not been illustrated in FIG. 3).

The control circuit just described is thus connected to conventional members forming part of the transmission and of the direct control of the latter. These are conventional means, so only the main means in question will be recalled.

Thus, there is a reverser with two multiple-disc clutches 69, 70 associated respectively with forward movement and with movement in reverse. This reverser is connected hydraulically to the valve means 60 which consist essentially of a solenoid 71 for cutting off the connected clutch, a distributor 72 and a pressure-regulating valve 73. It is important to note that the clutch cut-off solenoid 71 is excited by the current coming from the circuit described above. Moreover, the valve means 60 are incorporated in a conventional hydraulic circuit comprising a tank 74, a filter 75, a feed pump 76 and a circuit associated with the torque converter 77, comprising a safety valve 78 and cooler 79, the said circuit being connected to a branch 80 for the return to the tank 74. It is appropriate to note that the position of the slide of the distributor 72 is controlled from the cab by the reverser control lever.

There will now be an examination of the general mode of operation when the reverser control lever is in neutral and the driver wishes to raised the stabilizers of the appliance in order to move the machine.

Since the reverser control lever is in neutral, the safety contactor 65 associated with the transmission is automatically closed and thus earths the terminal 48 of the relay 24.

At the moment when the driver acts on one and/or the other of the control levers 8 of the stabilizers, the microswitch or microswitches 23 are actuated and close the circuit. The current is then transmitted momentarily to the terminal 47 of the relay 24 and to the terminal 54 of the relay 25: the relays 24 and 25 are consequently excited, so that the associated moveable contact members 46, 53 leave their position of rest and make contact between the terminals 49, 50 for the relay 24, on the one hand, and 56, 57 for the relay 25, on the other hand. Because the terminal 56 of the relay 25 is fed by means of the terminal 51 of the relay 24, in this position no current reaches the terminal 57 of the relay 25, the feed of current to which is thus cut off.

Moreover, the diode 26 prevents the current coming from the microswitch or microswitches 23 from flowing towards the acoustic warning indicator 22, on the one hand, and towards the clutch cut-off solenoid 71, on the other hand. As regards the distributor 72, this is, of course, in the neutral position, (corresponding to that shown in FIG. 4), so that the fluid circulates only in the direction of the torque converter 77 with a return to the tank 74.

Consequently, the stabilizers can be raised without any abnormality occurring in operation.

There will now be an examination of the general mode of operation when the reverser control lever is not in neutral and is in the front or rear position, and when the driver wishes to raise the stabilizers in order to move the machine.

Because the reverser control lever is in this position, the safety contactor 65 is opened automatically, so that the relay 24 cannot be earthed at 48.

At the moment of the operation to raise the stabilizers, the microswitch or microswitches 23 are actuated and the current is then transmitted, as before, to the terminal 47 of the relay 24 and to the terminal 54 of the relay 25. In this case, however, only the relay 25 is excited because of the opening of the safety contactor 65.

Contact is then made between the terminals 56 and 57 of the relay 25, and because the moveable contact member 46 of the relay 24 is in the position of rest (the position indicated in FIG. 4) the current coming from the terminal II can feed the terminal 54 of the relay 25, so that the said relay remains excited. Thus, the current will actuate the clutch cut-off solenoid 71, so that the transmission is automatically put into neutral (that is to say, the reverser is returned to the neutral position).

The current also passes along the branch 37 and thus causes the acoustic warning indicator 22 to operate, thereby advising the operator that the transmission has been put into neutral.

Consequently, despite the undesirable position of the reverser control lever, it will have been possible to raise the stabilizers, without the machine being moved when the rear wheel touched the ground.

Finally, it is appropriate to examine the general mode of operation when the appliance is put back into operation as is necessary after the preceding action.

According to the invention, the control means 23, 24, 25, 26 lever, as long as the control lever 17 of the reverser has not been retuned to neutral. The invention thus provides an extremely simple means for putting the system back into operation: the driver simply has to return the reverser control lever to neutral, without having to carry out the least additional operation.

In fact, the mode of operation in this hypothesis of putting the system back into operation will now be examined. When the driver returns the reverser control lever to neutral, the safety contactor 65 is closed once again, so that the relay 24 is excited once more, not by the current arriving via the microswitches, since these are open again, but via the terminal 57 of the relay 25, by way of the diode 26, to the supply input 47: the trigger coil 45 is excited and the movable contact member 46 leaves its position of rest, so that the terminal 51 of the said relay 24 is no longer fed, thus de facto cutting the feed to the terminal 56 of the relay 25 and consequently the feed of the acoustic warning indicator 22, on the one hand, and the feed of the clutch cut-off solenoid 71, on the other hand. The inputs 47 and 54 of the two relays 24 and 25 are therefore cut off, and the said relays are no longer excited, thereby allowing the normal movement of the machine.

Thus, the driver puts the system as a whole back into operation simply by returning the reverser control lever to neutral, and a new position of the said reverser control lever automatically causes the movement of the machine in the desired direction.

It will be seen that the safety device just described is extremely reliable. In fact, in the unfavourable case where the reverser control lever is not in neutral, the safety device is reactivated as soon as the driver acts on any one of the stabilizer control levers, and remains activated even it the driver, noticing the incorrect operation, decides not to act on the relevant lever or levers any longer. This is explained by the fact that, in this case, the trigger coil of the relay 25 is self-fed and therefore no longer depends on the position of the stabilizer control lever from the moment when the safety device is reactivated.

Moreover, as stated above, the diodes 42 and 43 make it possible to ensure highly satisfactory operation:

the diode 42 prevents the transmission from being cut off in the event of normal use of the acoustic warning indicator 22 (if a special luminous alarm device is used instead of acting on the acoustic warning indicator it is then possible to do without the diode 42);

the diode 43 prevents the warning indicator from functioning when the operator uses a safety member making it possible to put the transmission reverser into the neutral position automatically (safety member 68) by acting on the pushbutton provided at the end of the loader lever and/or of the pedal provided specially for a rapid cut-off.

It may be pointed out, as a reminder, that the diode 26 takes effect only when the reverser control lever is in neutral, in order to prevent the current coming from the microswitches from flowing towards the acoustic warning indicator and towards the clutch cut-off solenoid.

It goes without saying that the invention is in no way limited to the embodiments just described, but on the contrary embraces any alternative version incorporating, with equivalent means, the essential characteristics appearing in the claims. For example, the levers 8 and/or 17 can be replaced by rotary control members.

We claim:

1. Safety device intended for equipping a self-propelled appliance, especially a public works appliance of the shovel loader type, the said appliance possessing a transmission with a clutch reverser, the position of which is controlled by associated valve means, and at least one stabilizer, of which the position relative to the ground is controlled by an associated member, the said device having control means connecting the control member of the stabilizer functionally to the valve means controlling the position of the clutch reverser of the transmission, the said control means being passive when action is taken on the said member and the reverser is in the neutral position and being active when action is taken on the said member and the reverser is not in the neutral position, in order, in the latter case, to put the said reverser into the neutral position automatically.

2. Safety device according to claim 1, wherein the control means are active only when action is taken on the control member of the stabilizer for the purpose of raising the said stabilizer.

3. Safety device according to claim 2, intended for equipping an appliance possessing at least two stabilizers, the position of each of the aid stabilizers relative to the ground being controlled by an associated member, wherein the control means are active when action is taken on any one of the stabilizer control members and when the reverser is not in the neutral position.

4. Safety device according to claim 1, claim 2 or claim 3, intended for equipping an appliance possessing a clutch-reverser control member acting directly on the associated valve means, wherein the control means remain active when action is taken on the stabilizer control member or any one of the stabilizer control members, as long as the control member of the reverser has not been returned to neutral.

5. Safety device according to claim 1, wherein the control means connecting the stabilizer control member functionally to the valve means controlling the position of the reverser comprise:

a contactor associated with the or each stabilizer control member, the said contactor being fed continuously when the appliance is in operation;

a first switching member of the type comprising a relay with a movable contactor actuated by a trigger coil, the said coil being fed when the contactor is actuated;

a second switching member, likewise of the type comprising a relay with a movable contactor actuated by a trigger coil, the said coil being fed when the contactor is actuated, the input of the second switching member being connected to the output of the first switching member, whilst the output of the said second switching member is connected to the valve means; and rectifier means, such as a diode, disposed in an electrical connection between the output of the second switching member and the contactor, to prevent the stabilizer control member from exerting action on the said control means when the reverser is already in the neutral position.

6. Safety device according to claim 5, wherein the said device also has alarm means connected to the output of the second switching member, in such a way that the said alarm means are reactivated only when the neutral position is assumed as a result of the control means.

7. Safety device according to claim 6, wherein the alarm means consist essentially of the warning indicator of the appliance, second rectifier means, such as a diode, being provided to prevent normal use of the warning indicator from causing the control means to be actuated and the reverser to be put into the neutral position automatically.

8. Safety device according to claim 6, intended for equipping an appliance possessing a safety member mounted on the manual control member of an assembly and/or a foot-actuable safety member connected directly to the valve means controlling the position of the reverser for putting the reverser into the neutral position rapidly, third rectifier means, such as a diode, to prevent normal use of the safety member from causing the actuation of the alarm means, especially of the warning indicator of the appliance.

9. Safety device according to claim 7, intended for equipping an appliance possessing a safety member mounted on the manual control member of an assembly and/or a foot-actuable safety member connected directly to the valve means controlling the position of the reverser for putting the reverser into the neutral position rapidly, third rectifier means, such as a diode, to prevent normal use of the safety member from causing the actuation of the alarm means, especially of the warning indicator of the appliance.

10. Safety device according to claim 5, claim 6, claim 7, claim 8 or claim 9, intended for equipping an appliance possessing a clutch-reverser control member acting directly on the associated valve means and in which the control means remain active when action is taken on the stabilizer control member as long as the control member of the reverser has not been returned to neutral, and also possessing a relay associated with the starter and a safety contactor associated with the circuit of the trigger coil of the said relay which contactor is opened automatically when the control member of the reverser is not in neutral, wherein the circuit of the trigger coil of the first switching member is connected to the circuit associated with the said starter relay for the purpose of automatically exciting the said coil controlled by the said safety contactor when the control member of the reverser is in neutral.

11. Safety device according to claim 5, claim 6, claim 7, claim 8 or claim 9, intended for equipping an appliance possessing a general key-contact member, wherein the contactor associated with the stabilizer control member is fed directly from a terminal (II) of the general key-contact member.

12. Safety device according to claim 11, wherein the contactor is a microswitch.

* * * * *

UNITED STATES PATENT AND TRADEMARK OFFICE

CERTIFICATE OF CORRECTION

PATENT NO. : 4,825,567

DATED : May 2, 1989

INVENTOR(S) : Jose Andiano, Germain Houy and Michel Compin

It is certified that error appears in the above-identified patent and that said Letters Patent is hereby corrected as shown below:

In column 10, line 39, after "26" insert --remain active when action is taken on a stabilizer control--.

In claim 3, line 3, change "aid" to --said--.

Signed and Sealed this

Ninth Day of January, 1990

*Attest:*

JEFFREY M. SAMUELS

*Attesting Officer*

*Acting Commissioner of Patents and Trademarks*